US009653057B2

(12) United States Patent
Harada et al.

(10) Patent No.: US 9,653,057 B2
(45) Date of Patent: May 16, 2017

(54) ELECTRONIC WIND INSTRUMENT

(71) Applicant: CASIO COMPUTER CO., LTD., Tokyo (JP)

(72) Inventors: Eiichi Harada, Tokyo (JP); Katsutoshi Sakai, Tokyo (JP); Kazutaka Kasuga, Tokyo (JP); Ryutaro Hayashi, Tokyo (JP); Naotaka Uehara, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/004,644

(22) Filed: Jan. 22, 2016

(65) Prior Publication Data

US 2016/0275929 A1 Sep. 22, 2016

(30) Foreign Application Priority Data

Mar. 19, 2015 (JP) ..... 2015-055531

(51) Int. Cl.

| | |
|---|---|
| ***G10H 3/00*** | (2006.01) |
| ***G10H 1/44*** | (2006.01) |
| ***G10H 1/46*** | (2006.01) |
| ***G10H 1/055*** | (2006.01) |
| *G10H 1/32* | (2006.01) |

(52) U.S. Cl.

CPC ..... *G10H 1/44* (2013.01); *G10H 1/0551* (2013.01); *G10H 1/46* (2013.01); *G10H 1/32* (2013.01); *G10H 2220/361* (2013.01); *G10H 2230/205* (2013.01); *G10H 2230/221* (2013.01)

(58) Field of Classification Search

CPC .. G10H 3/16; G10H 1/46; G10H 1/44; G10H 1/32; G10H 2220/361; G10H 2230/205; G10H 2230/221; G10H 1/0551

USPC ..... 84/615, 723

See application file for complete search history.

(56) References Cited

U.S. PATENT DOCUMENTS

| | | | | |
|---|---|---|---|---|
| 5,543,580 A * | 8/1996 | Masuda | ..... | G10H 1/055 84/723 |
| 2012/0017748 A1* | 1/2012 | Beck | ..... | G09B 15/00 84/483.2 |
| 2013/0255474 A1* | 10/2013 | Hanks | ..... | G10H 1/342 84/615 |

FOREIGN PATENT DOCUMENTS

| | | | | |
|---|---|---|---|---|
| CA | WO 2008141459 A1 * | 11/2008 | ..... | A61F 4/00 |
| JP | H5-46170 A | 2/1993 | | |
| JP | H7-72853 A | 3/1995 | | |

* cited by examiner

*Primary Examiner* — Jeffrey Donels
(74) *Attorney, Agent, or Firm* — Chen Yoshimura LLP

(57) ABSTRACT

An electronic musical instrument includes: a contact sensor that generates lip detection information from an operation by a performer; and a controller that derives a lip contact area from the lip detection information generated by the contact sensor, and performs musical note control of an electronic sound source in accordance with the derived lip contact area.

19 Claims, 12 Drawing Sheets

Distance between contact sensor and distance sensor

Distance between contact sensor and distance sensor

Distance between contact sensor and distance sensor

ELECTRONIC WIND INSTRUMENT

BACKGROUND OF THE INVENTION

Technical Field

The present invention relates to an electronic musical instrument.

Background Art

In conventional acoustic wind instruments (single-reed woodwind instruments such as the saxophone and the clarinet), changes in the positioning and pressure of the lips and tongue on the reed cause variation in the tones of the musical notes produced, thereby allowing for a rich repertoire of musical expressions.

Meanwhile, there are also electronic wind instruments that electronically synthesize and output musical notes. In such electronic wind instruments, pressure-sensitive lip detectors (pressure-sensitive sensors) are arranged in a matrix on the reed and detect the positioning of the lips and tongue to control the musical notes (Japanese Patent Application Laid-Open Publication No. H7-72853).

SUMMARY OF THE INVENTION

In acoustic wind instruments, the musical notes can be controlled using very slight adjustments in the contact force and positioning of the lips and tongue. In the electronic wind instrument disclosed in Patent Document 1, however, response time is poor due to the pressure-sensitive sensors, thereby making it impossible to achieve a satisfactory musical performance on par with that of an acoustic wind instrument.

The problem to solve in the present invention is how to produce satisfactory musical notes. Accordingly, the present invention is directed to a scheme that substantially obviates one or more of the above-discussed and other problems due to limitations and disadvantages of the related art.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument, including: a contact sensor that generates lip detection information from an operation by a performer; and a controller that derives a lip contact area from the lip detection information generated by the contact sensor, and performs musical note control of an electronic sound source in accordance with the derived lip contact area.

In another aspect, the present disclosure provides an electronic musical instrument, including: a contact sensor having a capacitive touch sensor; and a controller that performs musical note control of an electronic sound source in accordance with information detected by the capacitive touch sensor.

It is to be understood that both the foregoing general description and the following detailed description are exemplary and explanatory, and are intended to provide further explanation of the invention as claimed.

DETAILED DESCRIPTION OF THE EMBODIMENTS

Figure 1A:
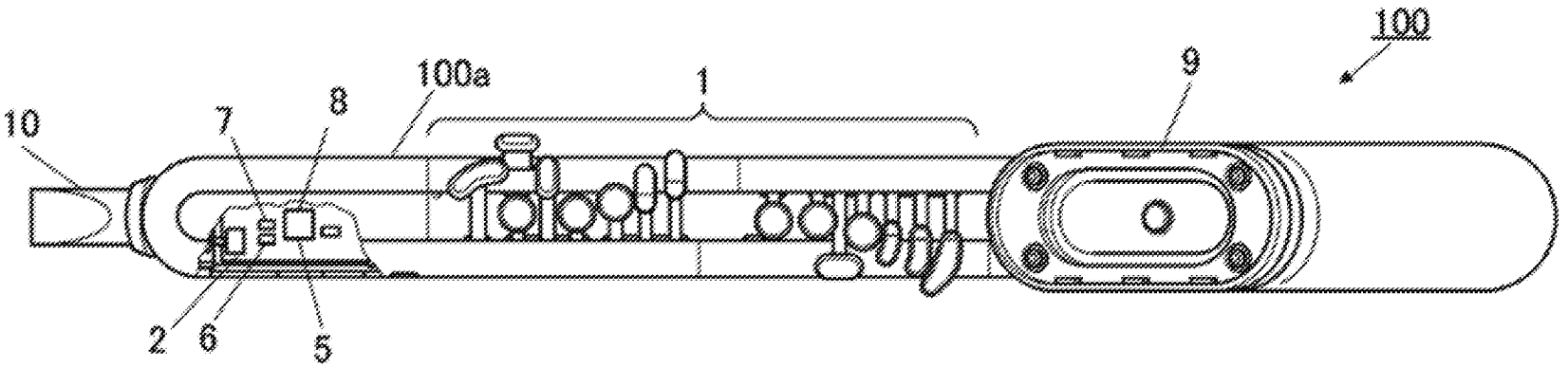
FIG. 1A is a plan view of an electronic musical instrument according to Embodiment 1 of the present invention.

Embodiments 1 to 3 of the present invention will be described in detail below with reference to the attached drawings.

It should be noted that the present invention is not limited to the examples illustrated in the drawings.

Embodiment 1

Figure 1B:
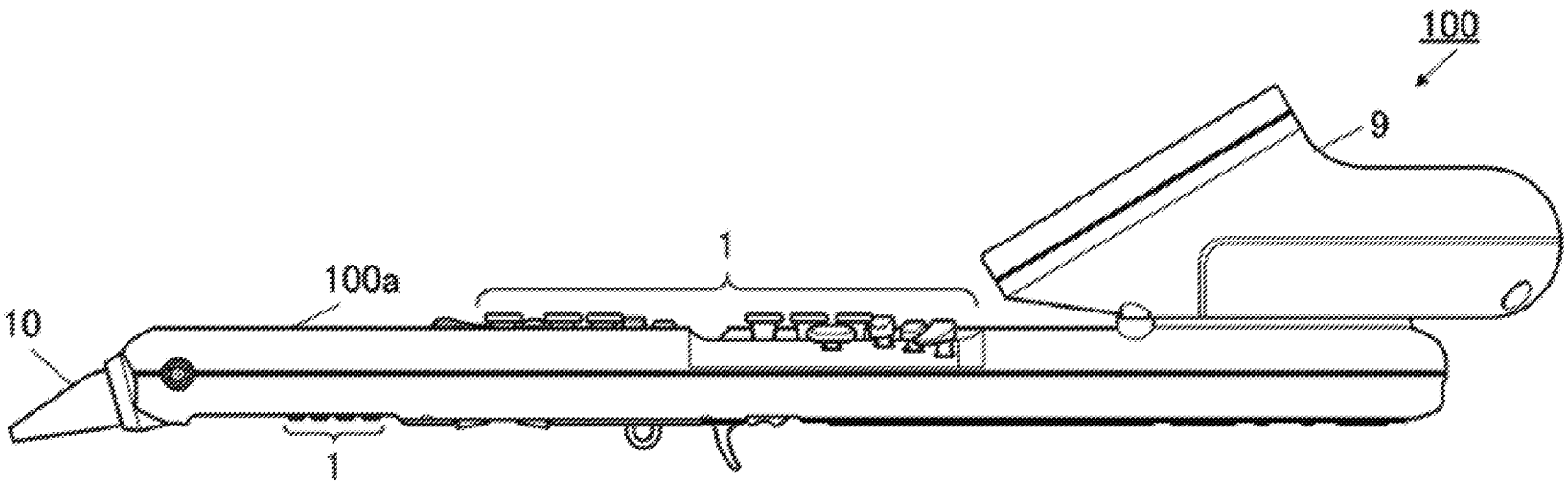
FIG. 1B is a side view of the electronic musical instrument.

Embodiment 1 of the present invention will be described with reference to FIGS. 1A to 8. First, the overall external configuration of the device of the present embodiment will be described with reference to FIGS. 1A and 1B. FIG. 1A is a plan view of an electronic musical instrument 100 according to the present embodiment. FIG. 1B is a side view of the electronic musical instrument 100.

The electronic musical instrument 100 of the present embodiment makes it possible to realize musical performance techniques used when playing an acoustic wind instrument (a single-reed woodwind instrument, for example) such as pitch bending and vibrato. The present embodiment will be described with the electronic musical instrument 100 being a saxophone as an example. However, the present invention is not limited to saxophones and may be applied to electronic versions of other single-reed wind instruments such as clarinets.

As illustrated in FIGS. 1A and 1B, the electronic musical instrument 100 of the present embodiment includes a body 100*a*, controls 1 on the body 100*a*, a sound system 9, and a mouthpiece 10. The electronic musical instrument 100 is shaped like an acoustic saxophone.

The body 100*a* is shaped like the main body of a saxophone. The controls 1 can be operated by the fingers of the performer (user) and include performance keys that determine pitch as well as settings keys for setting the type of wind instrument to emulate (saxophone, trumpet, synth lead, oboe, clarinet, flute, or the like), for changing the pitch according to the key of a song, for fine-tuning pitch, and the like. The mouthpiece 10 is operated by the performer's mouth and will be described in more detail later. The sound system 9 includes speakers or the like and outputs musical notes.

As illustrated in the partial through-view of the electronic musical instrument 100 in FIG. 1A, an air stream pressure detector 2, a central processing unit (CPU) 5 that functions as a controller, a read-only memory (ROM) 6, a random access memory (RAM) 7, and a sound source 8 (electronic sound source) are arranged on a substrate inside the body 100*a*.

The air stream pressure detector 2 detects the pressure of the stream of air blown into the mouthpiece 10 by the performer. The sound source 8 is a circuit that generates musical notes.

Figure 2:
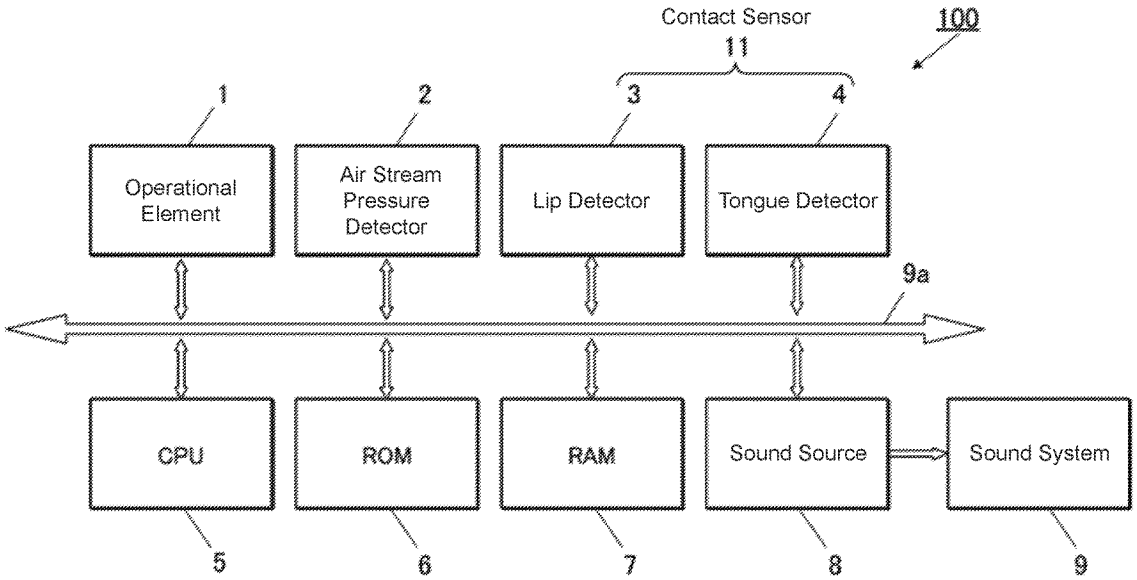
FIG. 2 is a block diagram illustrating a functional configuration of the electronic musical instrument.

Next, the functional configuration of the electronic musical instrument 100 will be described with reference to FIG. 2. FIG. 2 is a block diagram illustrating the functional configuration of the electronic musical instrument 100.

As illustrated in FIG. 2, the electronic musical instrument 100 includes the controls 1, the air stream pressure detector 2, a lip detector 3 that functions as a lip detecting scheme, a tongue detector 4 that functions as a tongue detecting scheme, the CPU 5 (controller), the ROM 6, the RAM 7, the sound source 8, and the sound system 9. All of the components of the electronic musical instrument 100 other than the sound system 9 are connected together by a bus 9*a*.

The controls 1 which include the performance keys, the settings keys, and the like receive key operations from the performer, and the resulting operation information is output to the CPU 5. In addition to setting the type of wind instrument to emulate, changing the pitch according to the key of a song, and fine-tuning pitch, the settings keys can also be used to pre-select a fine-tuning mode in which the tone, the volume, or the pitch of musical notes is fine-tuned according to the lip contact position and the lip contact area as detected by the lip detector 3. The air stream pressure detector 2 detects the pressure of the stream of air blown into the mouthpiece 10 by the performer and outputs the resulting pressure information to the CPU 5.

The lip detector 3 is formed on the mouthpiece 10 and is a capacitive touch sensor that detects contact between the performer's lips and a contact sensor 11. The capacitance of the touch sensor changes according to changes in the lip contact position and the lip contact area and is output to the CPU 5 as lip detection information. The tongue detector 4 is also formed on the mouthpiece 10 and is a capacitive touch sensor that detects contact between the performer's tongue and the contact sensor 11. The capacitance of the touch sensor changes according to changes in the contact area of the tongue and is output to the CPU 5 as tongue detection information.

The CPU 5 controls the components of the electronic musical instrument 100. The CPU 5 loads a specified program from the ROM 6 and runs it using the RAM 7. The CPU 5 uses the running program to execute the various processes used. More specifically, the CPU 5 sends musical note generation instructions to the sound source 8 on the basis of the operation information from the controls 1, the pressure information from the air stream pressure detector 2, the lip detection information from the lip detector 3, and the tongue detection information from the tongue detector 4. The CPU 5 sets the pitch of the musical note according to the pitch by the operation information from the controls 1 and also sets the volume of the musical note according to the pressure information from the air stream pressure detector 2. The CPU 5 fine-tunes at least one of the tone, volume, and pitch of the musical note according to the lip contact position and the lip contact area specified by the lip detection information from the lip detector 3. The CPU 5 also sets whether the musical note is on or off according to the tongue detection information from the tongue detector 4.

The ROM 6 is a read-only semiconductor memory and stores various types of data and programs. The RAM 7 is a volatile semiconductor memory and has a working area that temporarily stores data and programs.

The sound source 8 is a synthesizer that generates a musical note according to a musical note generation instruction (musical note control) generated by the CPU 5 on the basis of the operation information from the controls 1, the lip detection information from the lip detector 3, and the tongue detection information from the tongue detector 4. The sound source 8 then outputs the resulting musical note signal to the sound system 9. The sound source 8 includes an LPF that filters the musical note signal. However, the LPF may also be provided between the sound source 8 and the sound system 9 or as part of the sound system 9. The sound system 9 performs amplification and the like on the musical note signal from the sound source 8 and outputs the resulting signal as a musical note from a built-in speaker.

Figure 3A:
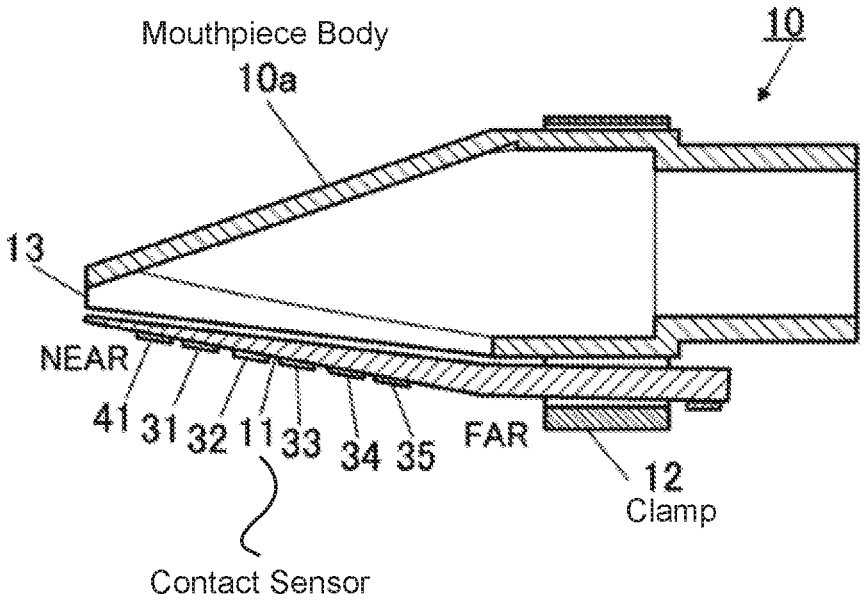
FIG. 3A is a cross-sectional view of a first mouthpiece.
Figure 3B:
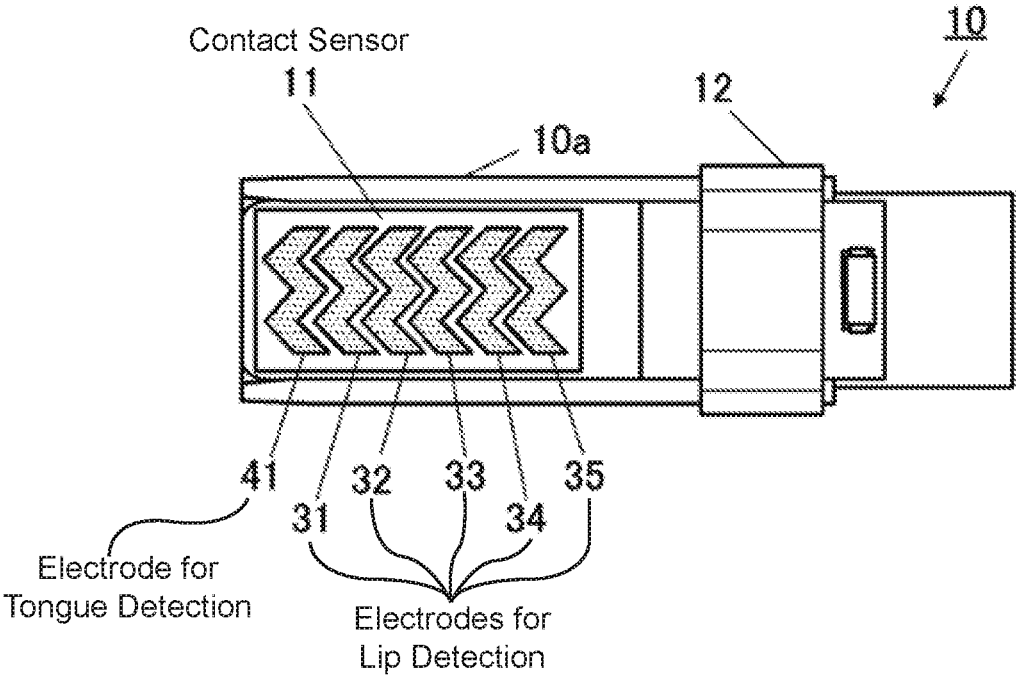
FIG. 3B is a bottom view of the first mouthpiece.

Next, the configuration of the mouthpiece 10 will be described with reference to FIGS. 3 to 5. FIG. 3A is a cross-sectional view of the mouthpiece 10. FIG. 3B is a bottom view of the mouthpiece 10.

As illustrated in FIGS. 3A and 3B, the mouthpiece 10 includes a mouthpiece body 10*a*, a contact sensor 11, and a clamp 12. The mouthpiece body 10*a* includes an opening 13 into which the performer blows and is connected to the body 100*a*. The contact sensor 11 has a thin single-layer sheet shape and includes the lip detector 3 and the tongue detector 4. The contact sensor 11 forms the bottom of the mouthpiece body 10*a* and is arranged in a position corresponding to the reed in an acoustic wind instrument. In an acoustic wind instrument, the reed vibrates due to the air blown by the performer and functions as a sound source. However, the contact sensor 11 does not function as a sound source and therefore may be a non-vibrating member. The clamp 12 fixes the contact sensor 11 to the mouthpiece body 10*a*.

Note that in FIG. 3A, the side of the mouthpiece 10 closer to the performer's mouth in the axial direction of the mouthpiece 10 is the "near" side, and the side closer to the body 100*a* is the "far" side. As illustrated in FIG. 3B, wave-shaped electrodes 41, 31, 32, 33, 34, and 35 are arranged and exposed on the contact sensor 11 in order from the near side to the far side. The electrode 41 is the electrode of a capacitive touch sensor S for the tongue detector 4. The electrodes 31, 32, 33, 34, and 35 are the electrodes of the capacitive touch sensor S for the lip detector 3. The electrodes 41, 31, 32, 33, 34, and 35 are arranged on top of a single touch sensor S. Alternatively, the electrodes 41, 31, 32, 33, 34, and 35 may be arranged on six separate touch sensors. The electrodes 41, 31, 32, 33, 34, and 35 are connected to the bus 9*a* via wires in the mouthpiece body 10*a*.

Next, the capacitive touch sensor S used for the lip detector 3 and the tongue detector 4 will be described with reference to FIG. 4. FIG. 4 conceptually illustrates the structure of the capacitive touch sensor S.

Figure 4:
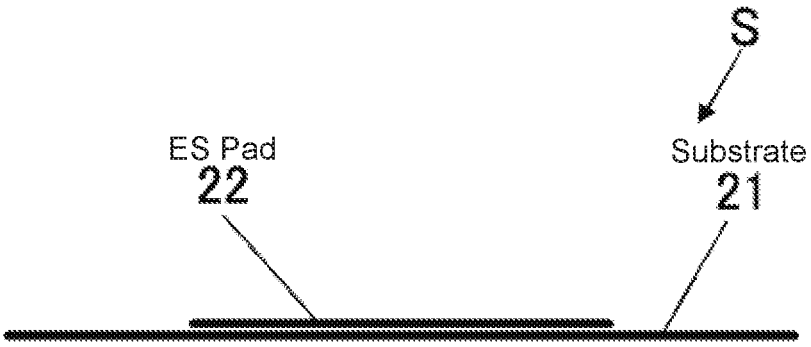
FIG. 4 conceptually illustrates a structure of a capacitive touch sensor.

As illustrated in FIG. 4, the capacitive touch sensor S includes an electrostatic pad 22 that includes the electrodes and that is arranged on top of a substrate 21. The substrate 21 may be a flexible insulating substrate such as a flexible printed circuit (FPC) or a standard insulating substrate such as a printed circuit board (PCB), for example.

Patent Document 1 (listed in the Background Art section) discloses a pressure-sensitive sensor. In this pressure-sensitive sensor, a pressure-sensitive device is sandwiched between two resin sheets arranged facing one another. A first electrode is arranged on the first (the lower) resin sheet, and a pressure-sensitive material is arranged covering the first electrode. The pressure-sensitive material is a coating that deforms when pressure is applied thereto and exhibits a decrease in electrical resistance according to the magnitude of the applied pressure. A second electrode is arranged on the second (the upper) resin sheet, which is arranged facing the first (lower) electrode. A spacer prevents the second electrode from contacting the pressure-sensitive material when no external force is applied to the assembly. When using a pressure-sensitive sensor, the resolution that can be achieved for parameters such as contact position and contact area is extremely low, which makes it difficult to fine-tune output according to the pressure applied.

In contrast, the touch sensor S can be mounted without the need to maintain a space as is needed with the pressure-sensitive sensor. This is because the only sensing element of the touch sensor S is the electrostatic pad 22, which makes it possible for the structure of the touch sensor S to be simpler and thinner than that of a pressure-sensitive sensor.

Moreover, the touch sensor S exhibits better detection precision than a pressure-sensitive sensor. This is because a pressure-sensitive sensor has a minimum detectable load, and a force on the order of 0.2N must be applied to register a reading. In contrast, the touch sensor S detects changes in capacitance and can detect even the small changes in capacitance that occur before contact is actually made with the sensor. No physical pressure needs to be applied, which makes it possible to achieve a far higher contact detection precision than when using a pressure-sensitive sensor.

Figure 5:
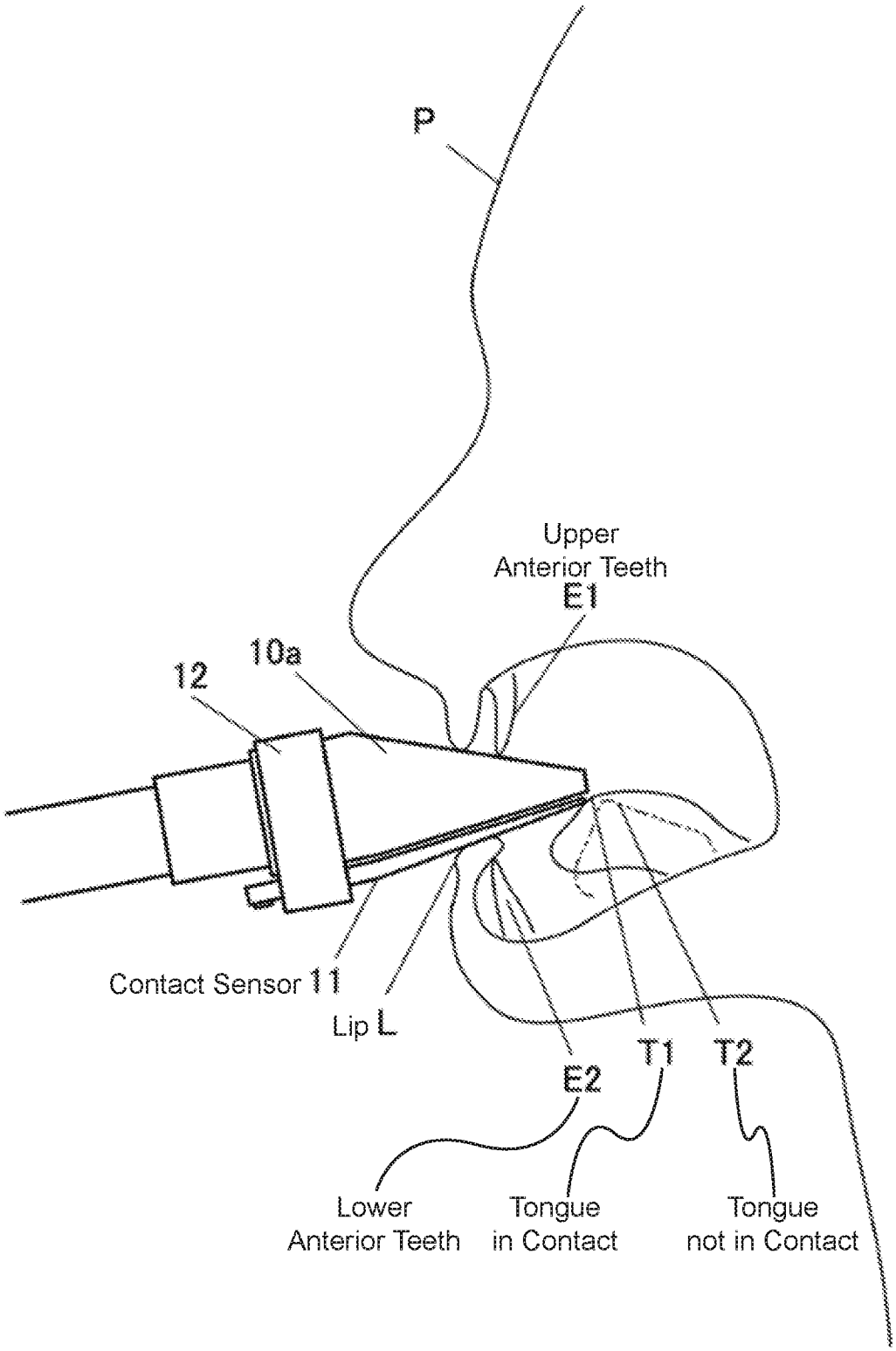
FIG. 5 illustrates how the mouthpiece fits into a performer's mouth.

FIG. 5 illustrates how the mouthpiece 10 fits into the mouth of a performer P. As illustrated in FIG. 5, when playing the electronic musical instrument 100, the upper anterior teeth E1 of the performer P are placed on the top portion of the mouthpiece body 10*a*. The lower lip L wraps around the lower anterior teeth E2 and contacts the contact sensor 11. In this way, the mouthpiece 10 is held between the upper anterior teeth E1 and the lip L. Depending on the playing techniques utilized during the performance, the tongue inside the mouth may take either of two states: a state T1 (indicated by the solid line) in which the tongue contacts the contact sensor 11, and a state T2 (indicated by the dashed line) in which the tongue does not contact the contact sensor 11.

The electrode matrix that includes the electrodes 41, 31, 32, 33, 34, and 35 functions as a uniaxial slider and can detect the contact state of the lip L and the tongue (T1: tongue in contact, T2: tongue not in contact) and then output the resulting detection information. Furthermore, the CPU 5 calculates the lip contact position and contact area using the detection information from the electrodes 31, 32, 33, 34, and 35 contacted by the lip. The CPU 5 can determine that a higher contact pressure is being applied when the lip contact area is larger, thereby making it possible to detect the contact pressure applied by the lips as well. Similarly, the CPU 5 uses the detection information output by the electrode 41 to determine whether the tongue is in contact with the contact sensor 11.

Note that although in the example described above the six electrodes 41, 31, 32, 33, 34, and 35 are used as the electrodes for the touch sensor S of the lip detector 3 and the tongue detector 4, the present invention is not limited to this configuration. The number, arrangement, and shape of the electrodes of the touch sensors S for the lip detector 3 and the tongue detector 4 may be configured as appropriate according to the design requirements at hand.

Figure 6C:
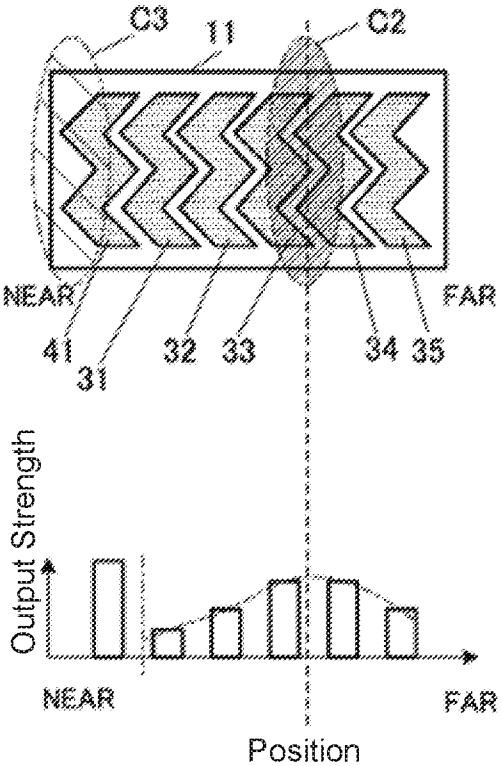
FIG. 6C includes a bottom view of the reed with the lip in the second lip contact region and the tongue in a tongue contact region as well as a graph showing the resulting touch sensor output.
Figure 6B:
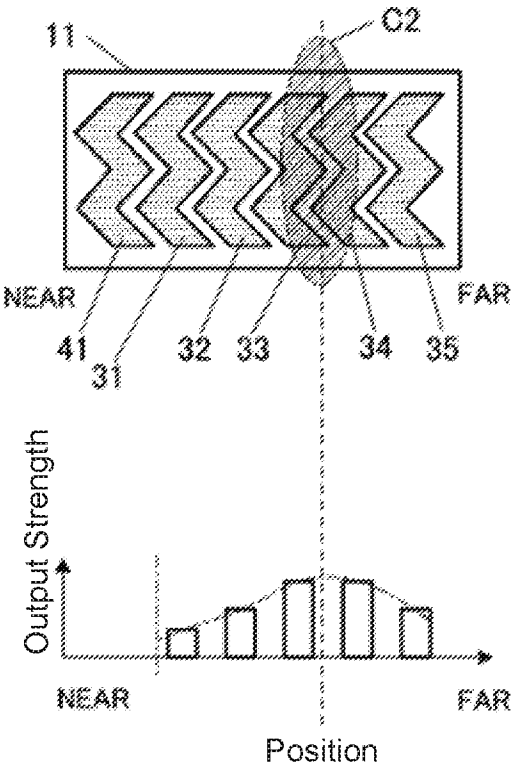
FIG. 6B includes a bottom view of the reed with the lip in a second lip contact region as well as a graph showing the resulting touch sensor output.
Figure 6A:
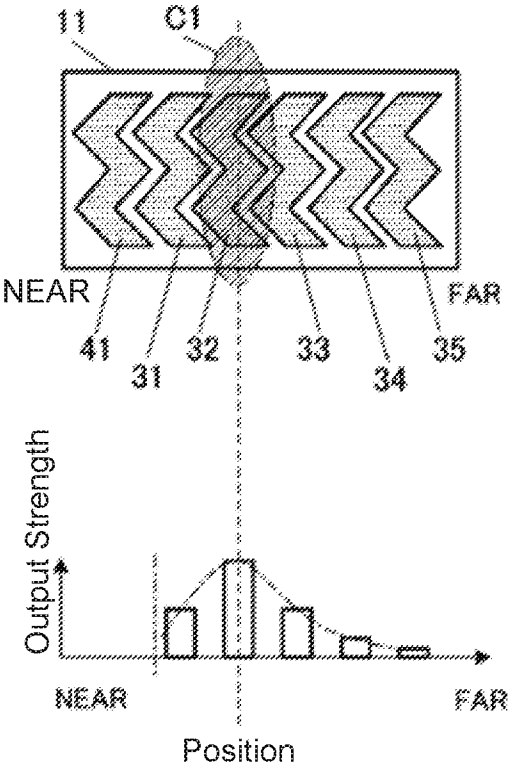
FIG. 6A includes a bottom view of a reed with the lip in a first lip contact region as well as a graph showing the resulting touch sensor output.

Next, the output strength of the touch sensor S used for the lip detector 3 and the tongue detector 4 will be described with reference to FIG. 6. FIG. 6A includes a bottom view of the contact sensor 11 with the lip in a lip contact region C1 as well as a graph showing the resulting output strength of the touch sensor S. FIG. 6B includes a bottom view of the contact sensor 11 with the lip in a lip contact region C2 as well as a graph showing the resulting output strength of the touch sensor S. FIG. 6C includes a bottom view of the contact sensor 11 with the lip in the lip contact region C2 and the tongue in a tongue contact region C3 as well as a graph showing the resulting output strength of the touch sensor S.

The graphs of the output strength of the touch sensor S in FIGS. 6A to 6C are bar graphs in which the horizontal axis is the position along the contact sensor 11 and the vertical axis is the output strength (output voltage) of the touch sensor S at the corresponding electrodes 41, 31, 32, 33, 34, and 35. As illustrated in FIG. 6A, when the performer's lip is pressed most strongly at the lip contact region C1, the touch sensor S produces an output distribution in which the output is strongest at the electrode 32, which corresponds to the lip contact region C1. Moreover, as illustrated in FIG. 6B, when the performer's lip is pressed most strongly at the lip contact region C2, the touch sensor S produces an output distribution in which the output is strongest at the electrodes 33 and 34, which correspond to the lip contact region C2. However, the output strength of the touch sensor S at the electrode 41 is zero.

In this way, electrodes adjacent to the electrodes contacted by the lip in the lip contact region also register changes in the capacitance of the capacitive touch sensor S. The CPU 5 assigns the lip contact position to the center of the lip contact region (such as C1 or C2) in which the output of the touch sensor S (which is used as the detection information for the lip detector 3) is strongest. It is preferable that the CPU 5 calculate the total lip contact area using the output values from each of the electrodes 31, 32, 33, 34, and 35 of the touch sensor S. However, the present invention is not limited to this scheme, and the lip contact area may be calculated using only the strongest output value from the electrodes 31, 32, 33, 34, and 35 of the touch sensor S.

As illustrated in FIG. 6C, when the performer's lip remains pressed at the lip contact region C2 and the tongue is used to contact the tongue contact region C3, the touch sensor S produces an output distribution in which the output at the electrodes 33 and 34 which correspond to the lip contact region C2 remains the same, but the electrode 41 which corresponds to the tongue contact region C3 produces a large output value. In this way, the CPU 5 can calculate the lip contact position and the lip contact area as well as determine whether or not the tongue is contacting the tongue contact region according to whether the output of the touch sensor S in the tongue contact region (which is used as the detection information for the tongue detector 4) is greater than or equal to a prescribed threshold value.

The output distributions described above are only examples corresponding to when six electrodes are used. Different output distributions can be obtained when different electrode configurations are used. For example, a larger number of finer electrodes can be used to increase the output resolution.

Figure 7A:
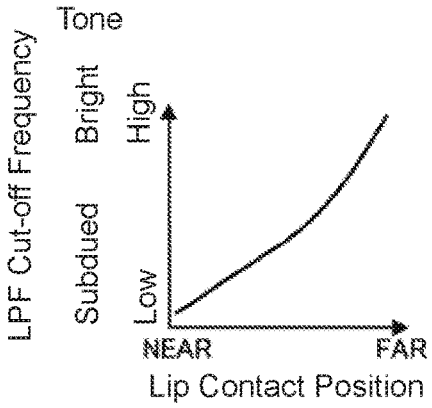
FIG. 7A is a graph showing the cutoff frequency control characteristics of a low-pass filter (LPF) relative to the lip contact position.
Figure 7C:
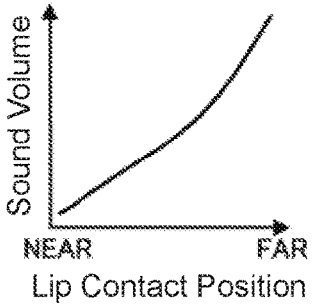
FIG. 7C is a graph showing volume control characteristics relative to lip contact position.
Figure 7E:
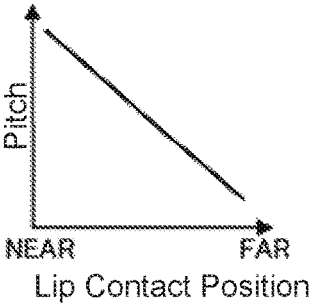
FIG. 7E is a graph showing pitch control characteristics relative to lip contact position.
Figure 7B:
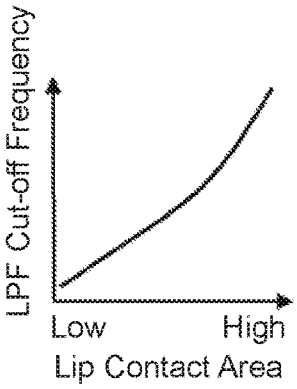
FIG. 7B is a graph showing the cutoff frequency control characteristics of the LPF relative to lip contact area.
Figure 7D:
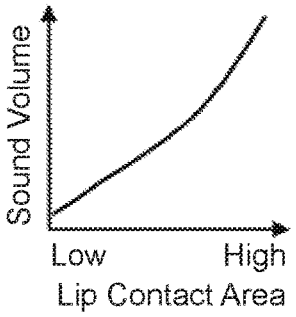
FIG. 7D is a graph showing volume control characteristics relative to lip contact area.
Figure 7F:
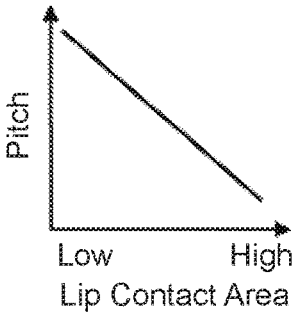
FIG. 7F is a graph showing pitch control characteristics relative to lip contact area.

Next, control of musical notes according to the detection information from the lip detector 3 will be described with reference to FIG. 7. FIG. 7A is a graph showing the cutoff frequency control characteristics of an LPF relative to lip contact position. FIG. 7B is a graph showing the cutoff frequency control characteristics of the LPF relative to lip contact area. FIG. 7C is a graph showing volume control characteristics relative to lip contact position. FIG. 7D is a graph showing volume control characteristics relative to lip contact area. FIG. 7E is a graph showing pitch control characteristics relative to lip contact position. FIG. 7F is a graph showing pitch control characteristics relative to lip contact area.

Three factors that determine the properties of a sound are tone, volume, and pitch. The CPU 5 controls what types of musical notes are generated by adjusting these three factors according to the lip contact position and the lip contact area specified by the detection information from the lip detector 3 and performing musical note control with respect to the sound source 8. As illustrated in FIG. 7A, when the settings keys are used to set the LPF cutoff frequency (the frequency above which higher frequencies begin to be attenuated) to change according to the lip contact position, the CPU 5 performs musical note control so as to increase the LPF cutoff frequency of the sound source 8 as the lip contact position moves closer to the far side and decrease the LPF cutoff frequency of the sound source 8 as the lip contact position moves closer to the near side, for example. The higher the LPF cutoff frequency, the "brighter" the tone of the notes produced.

As illustrated in FIG. 7B, when the settings keys are used to set the LPF cutoff frequency to change according to the lip contact area, the CPU 5 performs musical note control so as to increase the LPF cutoff frequency of the sound source 8 as the lip contact area increases and decrease the LPF cutoff frequency of the sound source 8 as the lip contact area decreases.

As illustrated in FIG. 7C, when the settings keys are used to set the volume at which the musical notes should be output by the sound system 9 (which is determined according to the pressure information from the air stream pressure detector 2) to be fine-tuned according to the lip contact position, the CPU 5 performs musical note control so as to increase the volume as the lip contact position moves closer to the far side and decrease the volume as the lip contact position moves closer to the near side.

Similarly, as illustrated in FIG. 7D, when the settings keys are used to set the volume at which the musical notes should be output by the sound system 9 (which is determined according to the pressure information from the air stream pressure detector 2) to be fine-tuned according to the lip contact area, the CPU 5 performs musical note control so as to increase the volume as the lip contact area increases and decrease the volume as the lip contact area decreases.

As illustrated in FIG. 7E, when the settings keys are used to set the pitch at which the musical notes should be output by the sound system 9 (which is determined according to the operation information from the performance keys of the controls 1) to be fine-tuned according to the lip contact position, the CPU 5 performs musical note control so as to decrease the pitch as the lip contact position moves closer to the far side and increase the pitch as the lip contact position moves closer to the near side.

As illustrated in FIG. 7F, when the settings keys are used to set the pitch at which the musical notes should be output by the sound system 9 (which is determined according to the operation information from the performance keys of the controls 1) to be fine-tuned according to the lip contact area, the CPU 5 performs musical note control to decrease the pitch as the lip contact area increases and increase the pitch as the lip contact position area decreases.

Moreover, it is preferable that one of the LPF cutoff frequency, the volume, and the pitch be set as a musical note control factor (a first musical note control factor) to be adjusted according to lip contact position as illustrated in FIGS. 7A, 7C, and 7E and also that one of the LPF cutoff frequency, the volume, and the pitch be set as a musical note control factor (a second musical note control factor that is different than the first musical note control factor) to be adjusted according to the lip contact area as illustrated in FIGS. 7B, 7D, and 7F, such that the performer can control the musical notes according to two different control factors.

Of the three factors, volume and pitch are the most important. Therefore, it is particularly preferable that the first musical note control factor be set to one of volume or pitch and that the second musical note control factor be set to the other of pitch and volume (that is, to the factor different than the first musical note control factor), such that the performer can control the musical notes according to two different and important control factors.

It should be noted that the combinations of musical note control schemes (of those illustrated in FIGS. 7A to 7F) used to control the musical notes are not limited to the examples described above. For example, LPF cutoff frequency may be set as the first musical note control factor and adjusted according to both the lip contact position and the lip contact area, as illustrated in FIGS. 7A and 7B. Similarly, volume may be set as the first musical note control factor and adjusted according to both the lip contact position and the lip contact area, as illustrated in FIGS. 7C and 7D, and likewise, pitch may be set as the first musical note control factor and adjusted according to both the lip contact position and the lip contact area, as illustrated in FIGS. 7E and 7F. Moreover, the control characteristics shown in FIGS. 7A to 7F may be linear or non-linear as long as there is a defined correlation between the parameters.

Figure 8:
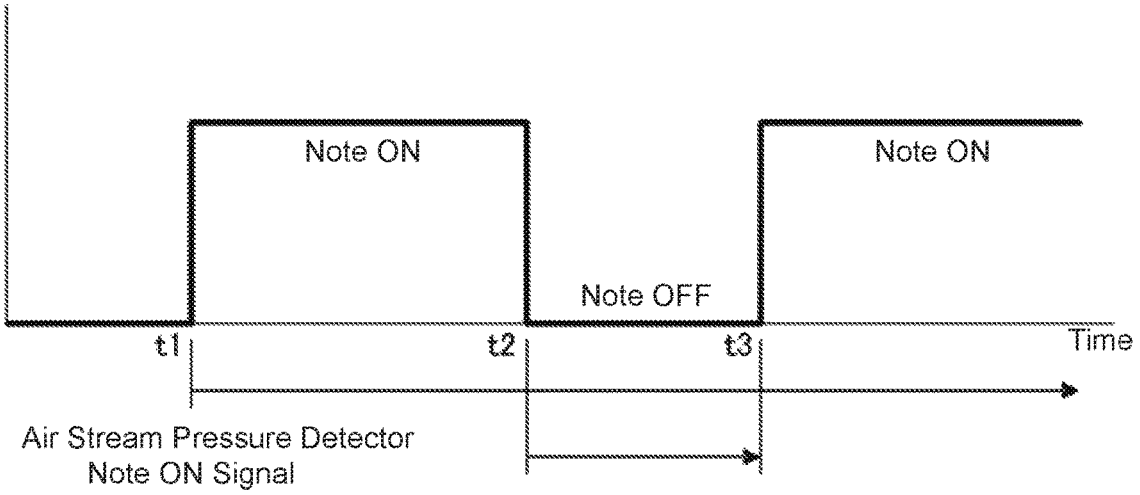
FIG. 8 is a graph showing an example of when a note is turned ON and OFF versus time.

Next, control of musical notes according to the detection information from the tongue detector 4 will be described with reference to FIG. 8. FIG. 8 is a graph showing an example of when a note is ON and OFF versus time.

The tongue detector 4 detects the contact state of the tongue. The CPU 5 controls what types of musical notes are generated by turning the notes ON and OFF according to whether the detection information from the tongue detector 4 indicates that tongue contact has been made. The CPU 5 then performs musical note control for turning the note ON and OFF according to the use of the tonguing technique to the sound source 8. Here, "tonguing technique" refers to a technique employed when playing acoustic wind instruments in which the tongue is brought into contact with the vibrating reed to stop that vibration, thereby preventing generation of sound.

Furthermore, when the air stream pressure detector 2 detects the pressure of air blown by the performer, the CPU 5 performs musical note control for turning notes ON and OFF according to that detected signal with respect to the sound source 8. Therefore, as illustrated in FIG. 8, the tonguing technique can be employed to leave the note on from time t1 to time t2, turn the note off from time t2 to time t3, and then allow the note to be turned back on again at time t3, for example.

If, starting at time t1, the performer continuously blows air into the mouthpiece 10, the air stream pressure detector 2 detects the resulting pressure, and the CPU 5 performs musical note control to turn the note on and adjust the volume according to the detected pressure. Then, if from time t2 to time t3 the performer's tongue contacts and remains in contact with the electrode 41 of the contact sensor 11, the CPU 5 prioritizes the tongue contact signal from the tongue detector 4 over the pressure detected by the air stream pressure detector 2 and performs musical note control to turn the note off. Next, at time t3, the tongue detector 4 detects that the tonguing technique is no longer being used, and the CPU 5 performs musical note control to turn the note back on according to the pressure detected by the air stream pressure detector 2.

In the present embodiment as described above, the electronic musical instrument 100 includes the contact sensor 11 having the capacitive touch sensor S and the CPU 5 that performs musical note control with respect to the sound source 8 according to detection information from the touch sensor S. This makes it possible to detect contact of the lip and the tongue even when the performer does not actually apply a force to the mouthpiece 10 as well as to improve responsiveness, better emulate the performance of an acoustic wind instrument, and produce satisfactory musical notes.

Furthermore, the touch sensor S includes the electrodes 31, 32, 33, 34, and 35 and detects contact of the performer's lip with those electrodes 31, 32, 33, 34, and 35. The CPU 5 calculates the lip contact position and the lip contact area using the detected lip contact information and performs musical note control with respect the sound source 8 according to at least one of the lip contact position and the lip contact area. This makes it possible to easily determine the lip contact position and the lip contact area even if the performer does not actually apply a force to the mouthpiece 10.

Moreover, when the appropriate settings are configured, the CPU 5 performs musical note control to change the tone, volume, or pitch of the musical note according to the lip contact position to the sound source 8. This makes it possible to produce satisfactory musical notes according to the desired note control factors.

The electronic musical instrument 100 also detects the contact area of the lip with the contact sensor 11 and includes the touch sensor S and the CPU 5 that control the musical notes generated by the sound source 8 according to the detected lip contact area. This makes it possible to detect the lip contact area even when the performer does not actually apply a force to the mouthpiece 10 as well as to improve responsiveness, better emulate the performance of an acoustic wind instrument, and produce satisfactory musical notes.

Moreover, when the appropriate settings are configured, the CPU 5 performs musical note control for changing the tone, volume, or pitch of the musical note according to the lip contact area to the sound source 8. This makes it possible to produce satisfactory musical notes according to the desired note control factors.

Furthermore, the touch sensor S includes the electrode 41 and detects contact of the performer's tongue with that electrode 41. The CPU 5 performs musical note control of the sound source 8 to turn the note ON and OFF according to the detected tongue contact state. This makes it possible to easily determine the contact state of the tongue even if the performer does not actually apply a force to the mouthpiece 10.

Furthermore, the electronic musical instrument 100 includes the tongue detector 4 that detects the contact state of the performer's tongue, and the CPU 5 performs musical note control of the sound source 8 according to the detected tongue contact state. This makes it possible to produce satisfactory musical notes according to the contact state of the tongue.

The CPU 5 also performs musical note control of the sound source 8 according to the contact state of the tongue. This makes it possible to easily enable use of the tonguing technique employed when playing acoustic wind instruments.

Embodiment 2

Figure 9A:
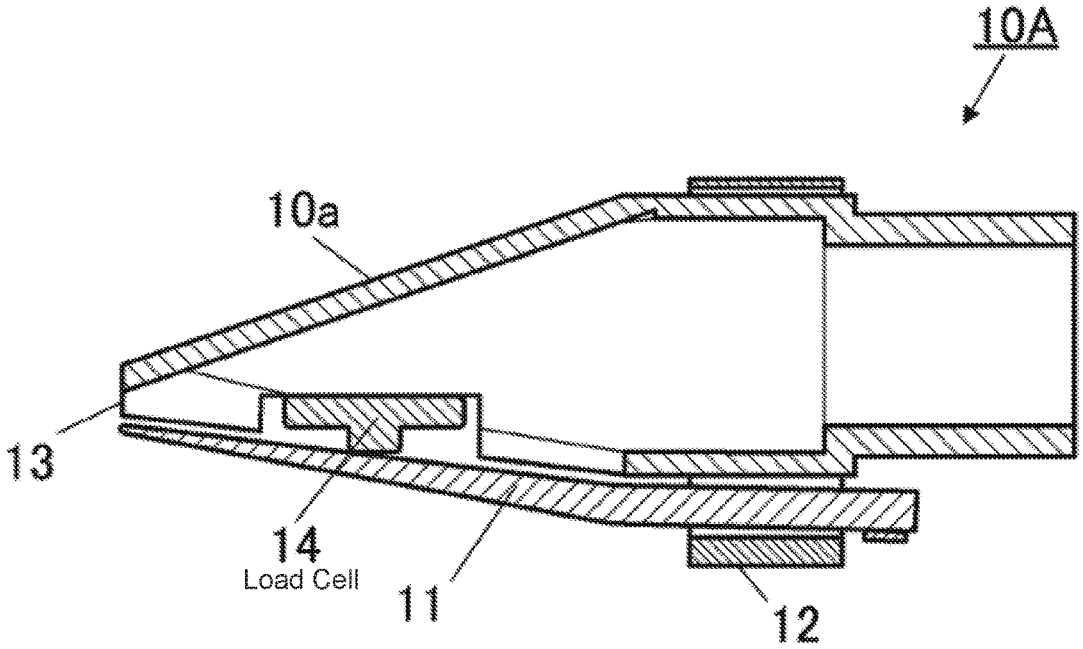
FIG. 9A is a cross-sectional view of a second mouthpiece.
Figure 9B:
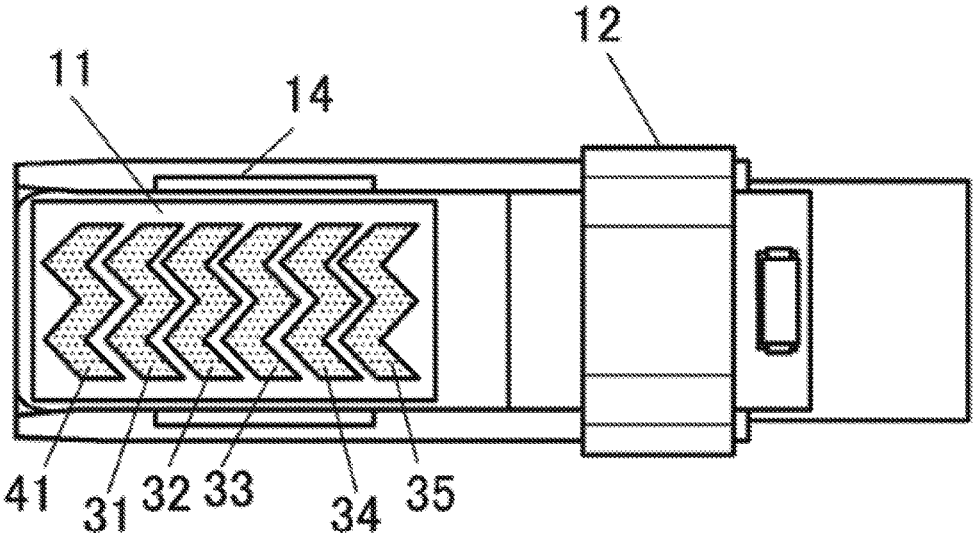
FIG. 9B is a bottom view of the second mouthpiece.

Next, Embodiment 2 of the present invention will be described with reference to FIGS. 9 and 10. FIG. 9A is a cross-sectional view of a mouthpiece 10A. FIG. 9B is a bottom view of the mouthpiece 10A.

In the present embodiment, the electronic musical instrument 100 is the same as in Embodiment 1 except in that the mouthpiece 10 is replaced with the mouthpiece 10A. The same reference characters are used to indicate components that are the same as the components used in the electronic musical instrument 100 of Embodiment 1, and descriptions of those components will be omitted here. Moreover, these components that are the same have the same functions as the components used in the electronic musical instrument 100, and descriptions of those functions will also be omitted here.

As illustrated in FIGS. 9A and 9B, the mouthpiece 10A includes a mouthpiece body 10*a*, a contact sensor 11, a clamp 12, and a load cell 14 that functions as a force detector. The contact sensor 11 is fixed in place by the clamp 12, and the near side of the contact sensor 11 is left free-floating. The contact sensor 11 bends due to the force applied when the performer's mouth closes, thereby making an opening 13 smaller. The contact sensor 11 must be made of an elastic material because the contact sensor 11 must be able to bend when force is applied thereto by the lip. The bending of the contact sensor 11 serves to provide the same feeling as playing an acoustic wind instrument. The characteristic feature of the present embodiment is that force applied to the contact sensor 11 is included as a parameter for controlling musical notes.

The load cell 14 is arranged on the inner side of the contact sensor 11, detects the force applied to the contact sensor 11, and outputs the detected load information to the CPU 5. The load cell 14 is connected to the bus 9*a* illustrated in FIG. 2. Moreover, the load cell 14 may be a general-purpose pressure sensor, a strain sensor, or a displacement sensor, for example.

Figure 10A:
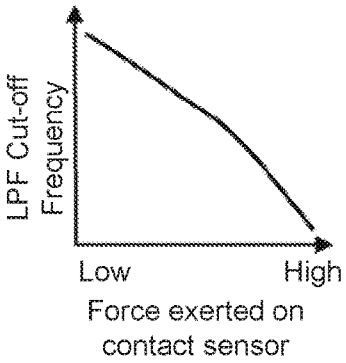
FIG. 10A is a graph showing the cutoff frequency control characteristics of an LPF relative to the force applied to the reed.
Figure 10B:
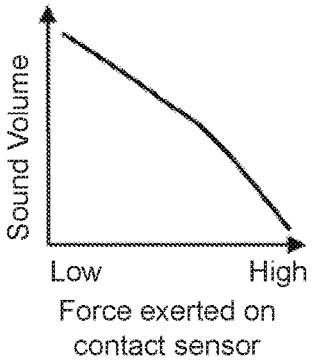
FIG. 10B is a graph showing volume control characteristics relative to the force applied to the reed.
Figure 10C:
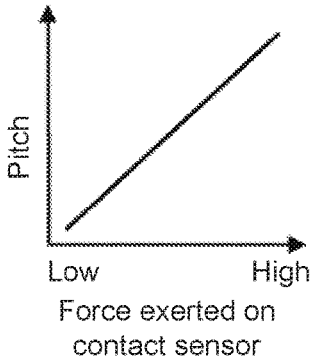
FIG. 10C is a graph showing pitch control characteristics relative to the force applied to the reed.

Next, control of musical notes according to the detection information from the load cell 14 will be described with reference to FIG. 10. FIG. 10A is a graph showing the cutoff frequency control characteristics of an LPF relative to the force applied to the contact sensor 11. FIG. 10B is a graph showing volume control characteristics relative to the force applied to the contact sensor 11. FIG. 10C is a graph showing pitch control characteristics relative to the force applied to the contact sensor 11.

As illustrated in FIG. 10A, the CPU 5 performs musical note control such that the LPF cutoff frequency decreases as the force applied to the contact sensor 11 (which is the detection information provided by the load cell 14) increases, and the LPF cutoff frequency increases as the force applied to the contact sensor 11 decreases, for example. As illustrated in FIG. 10B, the CPU 5 may alternatively perform musical note control such that the volume at which the musical notes should be output by the sound system 9 (which is determined according to the pressure information from the air stream pressure detector 2) decreases as the force applied to the contact sensor 11 increases, and the volume as the force increases applied to the contact sensor 11 decreases. As illustrated in FIG. 10C, the CPU 5 may alternatively perform musical note control such that the pitch at which the musical notes should be output by the sound system 9 (which is determined according to the operation information from the performance keys of the controls 1) increases as the force applied to the contact sensor 11 increases and the pitch decreases as the force applied to the contact sensor 11 decreases.

It is preferable that the musical note control factor corresponding to the force applied to the contact sensor 11 be different than the musical note control factors corresponding to the tongue contact position and the lip contact area. Moreover, the control characteristics shown in FIGS. 10A to 10C are only examples, and the present invention is not limited to these examples.

In the present embodiment as described above, the electronic musical instrument 100 includes the load cell 14 which detects the force applied to the contact sensor 11, and the force applied to the contact sensor 11 as detected by the load cell 14 is used to control the musical notes generated by the sound source 8. This makes it possible to perform musical note control according not only to tongue and lip contact with the touch sensor S but also according to the force applied to the contact sensor 11 as detected by the load cell 14, thereby making it possible to produce a wider variety of satisfactory musical notes.

Moreover, the CPU 5 performs musical note control for changing the tone, volume, or pitch of the musical notes according to the detected force applied to the contact sensor 11 to the sound source 8. This makes it possible to produce satisfactory musical notes according to the desired note control factors.

Embodiment 3

Figure 11A:
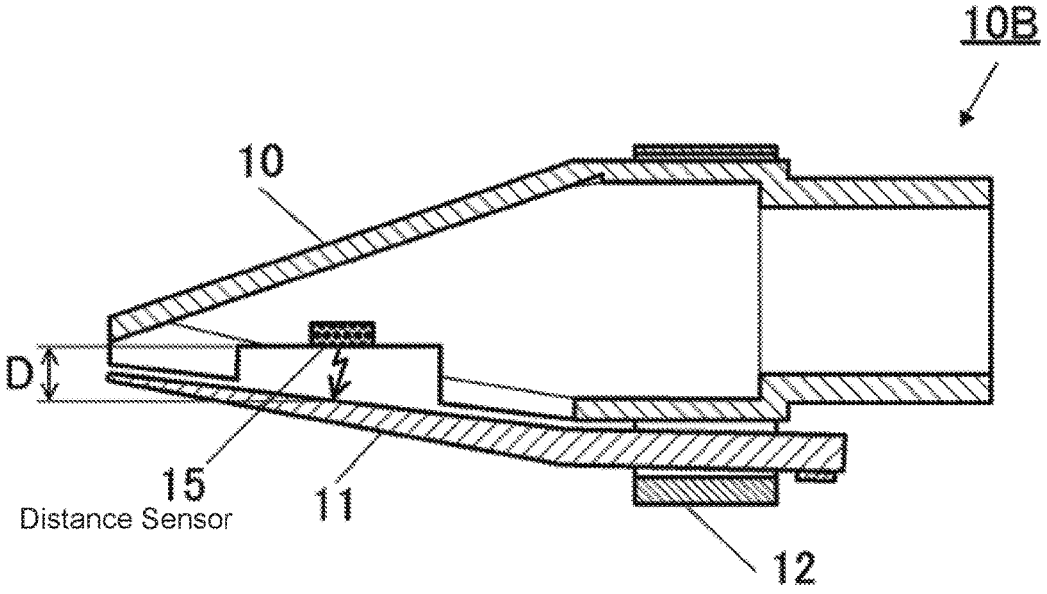
FIG. 11A is a cross-sectional view of a third mouthpiece.
Figure 11B:
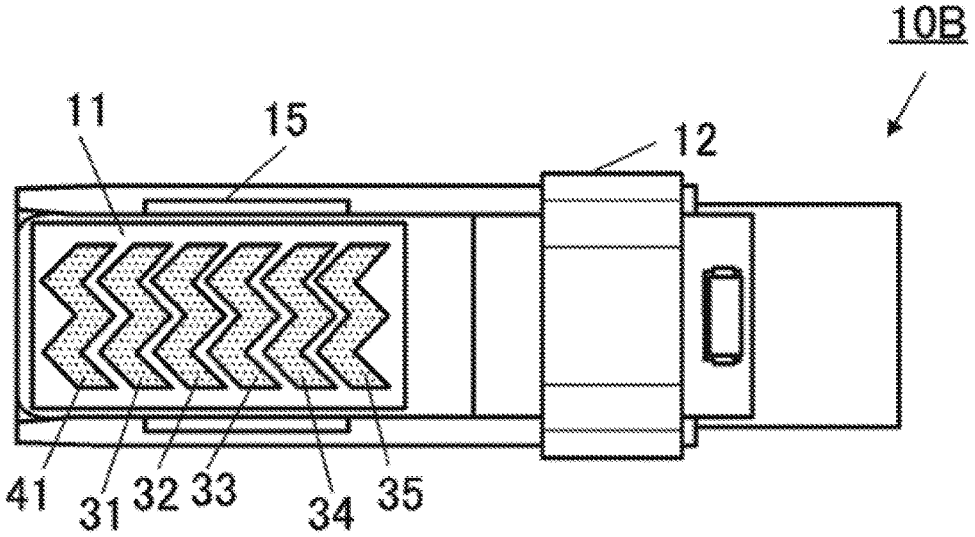
FIG. 11B is a bottom view of the third mouthpiece.

Next, Embodiment 3 of the present invention will be described with reference to FIGS. 11 and 12. FIG. 11A is a cross-sectional view of a mouthpiece 10B. FIG. 11B is a bottom view of the mouthpiece 10B.

In the present embodiment, the electronic musical instrument 100 is the same as in Embodiment 1 except in that the mouthpiece 10 is replaced with the mouthpiece 10B. The same reference characters are used to indicate components that are the same as the components used in the electronic musical instrument 100 of Embodiment 1, and descriptions of those components will be omitted here. Moreover, these components that are the same have the same functions as the components used in the electronic musical instrument 100, and descriptions of those functions will also be omitted here.

As illustrated in FIGS. 11A and 11B, the mouthpiece 110B includes a mouthpiece body 10*a*, a contact sensor 11, a clamp 12, and a distance sensor 15 that functions as a distance detector. The contact sensor 11 is the same as in Embodiment 2 and can undergo bending motions.

The distance sensor 15 is arranged on the inner side of the contact sensor 11, detects the distance D between the distance sensor 15 and the contact sensor 11, and outputs the detected distance information to the CPU 5. The distance sensor 15 is connected to the bus 9*a* illustrated in FIG. 2. Moreover, the distance sensor 15 is a reflective photointerrupter that detects the distance to the contact sensor 11 by emitting light and then capturing the light reflected by the contact sensor 11, for example.

Figure 12A:
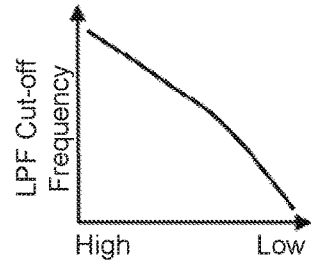
FIG. 12A is a graph showing the cutoff frequency control characteristics of an LPF relative to the distance between the reed and a distance sensor.
Figure 12B:
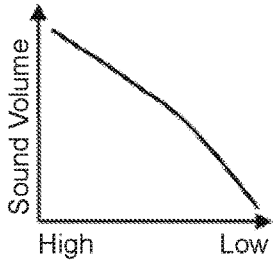
FIG. 12B is a graph showing volume control characteristics relative to the distance between the reed and the distance sensor.
Figure 12C:
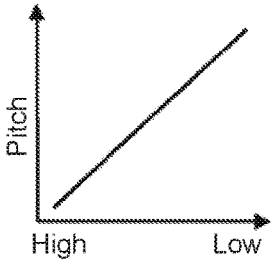
FIG. 12C is a graph showing pitch control characteristics relative to the distance between the reed and the distance sensor.

Next, control of musical notes according to the detection information from the distance sensor 15 will be described with reference to FIG. 12. FIG. 12A is a graph showing the cutoff frequency control characteristics of an LPF relative to the distance between the contact sensor 11 and the distance sensor 15. FIG. 12B is a graph showing volume control characteristics relative to the distance between the contact sensor 11 and the distance sensor 15. FIG. 12C is a graph showing pitch control characteristics relative to the distance between the contact sensor 11 and the distance sensor 15.

As illustrated in FIG. 12A, the CPU 5 performs musical note control so as to decrease the LPF cutoff frequency as the distance between the contact sensor 11 and the distance sensor 15 (which is the detection information provided by the distance sensor 15) decreases, and increase the LPF cutoff frequency as the distance between the contact sensor 11 and the distance sensor 15 increases, for example. As illustrated in FIG. 12B, the CPU 5 may alternatively perform musical note control so as to decrease the volume at which the musical notes should be output by the sound system 9 (which is determined according to the pressure information from the air stream pressure detector 2) as the distance between the contact sensor 11 and the distance sensor 15 decreases and increase the volume as the distance between the contact sensor 11 and the distance sensor 15 increases. As illustrated in FIG. 12C, the CPU 5 may alternatively perform musical note control so as to increase the pitch at which the musical notes should be output by the sound system 9 (which is determined according to the operation information from the performance keys of the controls 1) as the distance between the contact sensor 11 and the distance sensor 15 decreases, and decrease the pitch as the distance between the contact sensor 11 and the distance sensor 15 increases.

It is preferable that the musical note control factor corresponding to the distance between the contact sensor 11 and the distance sensor 15 be different than the musical note control factors corresponding to the tongue contact position and the lip contact area. Moreover, the control characteristics shown in FIGS. 12A to 12C are only examples, and the present invention is not limited to these examples.

The present embodiment as described above includes the distance sensor 15 which detects the distance to the contact sensor 11 as the contact sensor 11 bends, and the CPU 5 uses the distance to the contact sensor 11 as detected by the distance sensor 15 to control the musical notes generated by the sound source 8. This makes it possible to perform musical note control according not only to tongue and lip contact with the touch sensor S but also according to the distance to the contact sensor 11 as detected by the distance sensor 15, thereby making it possible to produce satisfactory musical notes.

Moreover, when the appropriate settings are configured, the CPU 5 performs musical note control for changing the tone, volume, or pitch of the musical notes according to the detected distance to the contact sensor 11 to the sound source 8. This makes it possible to produce satisfactory musical notes according to the desired note control factors.

The embodiments described above are only examples of a suitable application of the present invention to an electronic musical instrument, and the present invention is not limited to these examples.

For example, a shield electrode may be formed on top of the electrodes 41, 31, 32, 33, 34, and 35 of the touch sensor of the embodiments described above in order to reduce erroneous detections due to water moisture or drops of water.

Moreover, the more detailed aspects of the configuration and functions of the components of the electronic musical instrument 100 in the embodiments described above may be modified as appropriate without departing from the spirit of the present invention.

Embodiments of the present invention were described above. However, the present invention is not limited to these embodiments, and any configurations included in the scope of the claims and their equivalents are also encompassed by the present invention.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument, comprising:

a contact sensor that generates lip detection information from an operation by a performer; and a controller that derives a lip contact area from the lip detection information generated by the contact sensor, and performs musical note control of an electronic sound source in accordance with the derived lip contact area, wherein the contact sensor includes a tongue detector that detects a contact of a tongue of the performer, and wherein, based on whether the contact of the tongue occurs or not, the controller performs musical note control that is different from the musical note control of the electronic sound source based on the lip contact area.

2. The electronic musical instrument according to claim 1, further comprising:

a force detector that detects a force applied to the contact sensor, wherein the controller performs said musical note control of the electronic sound source in accordance with the force applied to the contact sensor detected by the force detector as well as the lip contact area.

3. The electronic musical instrument according to claim 1, further comprising:

a distance detector that detects a distance to the contact sensor from a reference point that changes due to a warp of the contact sensor, and wherein the controller performs said musical note control of the electronic sound source in accordance with the distance to the contact sensor detected by the distance detector as well as the lip contact area.

4. The electronic musical instrument according to claim 1, wherein said musical note control by the controller includes musical note control of the electronic sound source with respect to one or more among a tone, a volume, and a pitch of a sound to be generated by the electronic sound source.

5. The electronic musical instrument according to claim 2, wherein said musical note control by the controller includes control of the electronic sound source with respect to a tone, a volume and a pitch of a sound to be generated by the electronic sound source, and wherein one or two among the tone, the volume, and the pitch are controlled based on the lip contact area, and the remaining one or two among the tone, the volume, and the pitch are controlled based on the detected force applied to the contact sensor.

6. An electronic musical instrument, comprising:

a contact sensor having a capacitive touch sensor that detects a contact of a lip of a performer; and a controller that performs musical note control of an electronic sound source in accordance with information detected by the capacitive touch sensor.

7. The electronic musical instrument according to claim 6, wherein the contact sensor detects the lip of the performer and generates lip detection information, and wherein the controller derives at least one of a lip contact position and a lip contact area from the lip detection information generated by the contact sensor and performs musical note control of the electronic sound source in accordance with said at least one of the lip contact position and the lip contact area that has been derived.

8. The electronic musical instrument according to claim 7, wherein the contact sensor includes a tongue detector that detects a contact of a tongue of the performer, and wherein, based on whether the contact of the tongue occurs or not, the controller performs musical note control that is different from the musical note control of the electronic sound source based on the lip contact area.

9. The electronic musical instrument according to claim 6, further comprising:

a force detector that detects a force applied to the contact sensor, wherein the controller performs said musical note control of the electronic sound source in accordance with the force applied to the contact sensor detected by the force detector as well as the information detected by the capacitive touch sensor.

10. The electronic musical instrument according to claim 6, further comprising:

a distance detector that detects a distance to the contact sensor from a reference point that changes due to a warp of the contact sensor, and wherein the controller performs said musical note control of the electronic sound source in accordance with the distance to the contact sensor detected by the distance detector as well as the information detected by the capacitive touch sensor.

11. The electronic musical instrument according to claim 6, wherein said musical note control by the controller includes control of the electronic sound source with respect to one or more among a tone, a volume, and a pitch of a sound to be generated by the electronic sound source.

12. The electronic musical instrument according to claim 9, wherein said musical note control by the controller includes control of the electronic sound source with respect to a tone, a volume and a pitch of a sound to be generated by the electronic sound source, and wherein one or two among the tone, the volume, and the pitch are controlled based on the information detected by the capacitive touch sensor, and the remaining one or two among the tone, the volume, and the pitch are controlled based on the force applied to the contact sensor detected by the force detector.

13. The electronic musical instrument according to claim 10, wherein said musical note control by the controller includes control of the electronic sound source with respect to a tone, a volume and a pitch of a sound to be generated by the electronic sound source, and wherein one or two among the tone, the volume, and the pitch are controlled based on the information detected by the capacitive sensor, and the remaining one or two among the tone, the volume, and the pitch are controlled based on the distance to the contact sensor detected by the distance detector.

14. An electronic musical instrument, comprising:

a contact sensor having a capacitive touch sensor;

a controller that performs musical note control of an electronic sound source in accordance with information detected by the capacitive touch sensor; and a distance detector that detects a distance to the contact sensor from a reference point that changes due to a warp of the contact sensor, wherein the controller performs said musical note control of the electronic sound source in accordance with the distance to the contact sensor detected by the distance detector as well as the information detected by the capacitive touch sensor.

15. The electronic musical instrument according to claim 14, wherein said musical note control by the controller includes control of the electronic sound source with respect to a tone, a volume and a pitch of a sound to be generated by the electronic sound source, and wherein one or two among the tone, the volume, and the pitch are controlled based on the information detected by the capacitive sensor, and the remaining one or two among the tone, the volume, and the pitch are controlled based on the distance to the contact sensor detected by the distance detector.

16. An electronic musical instrument, comprising:

a contact sensor having a capacitive touch sensor;

a controller that performs musical note control of an electronic sound source in accordance with information detected by the capacitive touch sensor; and a force detector that detects a force applied to the contact sensor, wherein the controller performs said musical note control of the electronic sound source in accordance with the force applied to the contact sensor detected by the force detector as well as the information detected by the capacitive touch sensor, wherein said musical note control by the controller includes control of the electronic sound source with respect to a tone, a volume and a pitch of a sound to be generated by the electronic sound source, and wherein one or two among the tone, the volume, and the pitch are controlled based on the information detected by the capacitive touch sensor, and the remaining one or two among the tone, the volume, and the pitch are controlled based on the force applied to the contact sensor detected by the force detector.

17. An electronic musical instrument, comprising:

a contact sensor that generates lip detection information from an operation by a performer;

a controller that derives a lip contact area from the lip detection information generated by the contact sensor, and performs musical note control of an electronic sound source in accordance with the derived lip contact area; and a distance detector that detects a distance to the contact sensor from a reference point that changes due to a warp of the contact sensor, wherein the controller performs said musical note control of the electronic sound source in accordance with the distance to the contact sensor detected by the distance detector as well as the lip contact area.

18. The electronic musical instrument according to claim 17, wherein said musical note control by the controller includes control of the electronic sound source with respect to a tone, a volume and a pitch of a sound to be generated by the electronic sound source, and wherein one or two among the tone, the volume, and the pitch are controlled based on the lip contact area, and the remaining one or two among the tone, the volume, and the pitch are controlled based on the distance to the contact sensor detected by the distance detector.

19. An electronic musical instrument, comprising:

a contact sensor that generates lip detection information from an operation by a performer;

a controller that derives a lip contact area from the lip detection information generated by the contact sensor, and performs musical note control of an electronic sound source in accordance with the derived lip contact area; and a force detector that detects a force applied to the contact sensor, wherein the controller performs said musical note control of the electronic sound source in accordance with the force applied to the contact sensor detected by the force detector as well as the lip contact area, wherein said musical note control by the controller includes control of the electronic sound source with respect to a tone, a volume and a pitch of a sound to be generated by the electronic sound source, and wherein one or two among the tone, the volume, and the pitch are controlled based on the lip contact area, and the remaining one or two among the tone, the volume, and the pitch are controlled based on the detected force applied to the contact sensor.

* * * * *